US009956968B2

(12) United States Patent
Lin et al.

(10) Patent No.: US 9,956,968 B2
(45) Date of Patent: May 1, 2018

(54) BEARING ADAPTER SIDE FRAME INTERFACE FOR A RAILWAY CAR TRUCK

(71) Applicant: STRATO, INC., Piscataway, NJ (US)

(72) Inventors: David Yuh-Shyang Lin, Wayne, NJ (US); Thomas J. Heyden, Arlington Heights, IL (US); Thomas R. Berg, Saint Louis, MO (US); Christopher J. Clark, Hoboken, NJ (US); Kevin P. McGarvey, Jamesburg, NJ (US)

(73) Assignee: STRATO, INC., Piscataway, NJ (US)

( * ) Notice: Subject to any disclaimer, the term of this patent is extended or adjusted under 35 U.S.C. 154(b) by 528 days.

(21) Appl. No.: 14/577,031

(22) Filed: Dec. 19, 2014

(65) Prior Publication Data

US 2016/0176418 A1 Jun. 23, 2016

(51) Int. Cl.

| | |
|---|---|
| ***B61F 5/32*** | (2006.01) |
| ***B61F 5/30*** | (2006.01) |
| ***B61F 15/16*** | (2006.01) |
| ***B61F 15/20*** | (2006.01) |
| ***B61F 5/26*** | (2006.01) |

(52) U.S. Cl.

CPC ..... *B61F 5/32* (2013.01); *B61F 5/26* (2013.01); *B61F 5/305* (2013.01); *B61F 15/16* (2013.01); *B61F 15/20* (2013.01)

(58) Field of Classification Search

CPC ..... B61F 5/305; B61F 5/32

See application file for complete search history.

(56) References Cited

U.S. PATENT DOCUMENTS

| | | | |
|---|---|---|---|
| 2,465,965 | A | 3/1949 | Cottrell |
| 2,967,915 | A | 1/1961 | Dean |
| 3,358,615 | A | 12/1967 | Williams |
| 3,381,629 | A | 5/1968 | Jones |
| 3,461,814 | A | 8/1969 | Weber et al. |
| 3,548,755 | A | 12/1970 | Lich |
| 3,670,660 | A | 6/1972 | Weber et al. |
| 3,789,770 | A | 2/1974 | List |
| 3,844,226 | A | 10/1974 | Brodeur |
| 3,961,584 | A | 6/1976 | Paton et al. |

(Continued)

OTHER PUBLICATIONS

AAR Manual of Standards and Recommended Practices, Truck Performance for Rail Cars, Specification M-976, Sep. 2010.

(Continued)

*Primary Examiner* — Zachary L Kuhfuss
(74) *Attorney, Agent, or Firm* — Pearl Cohen Zedek Latzer Baratz LLP

(57) ABSTRACT

The invention relates to a railway car truck incorporating an interconnection between a side frame and a bearing adapter. The bearing adapter may receive a reduced coefficient of friction surface member in a recess on a top surface of the bearing adapter, facilitating a reduced lateral spring rate of the wheelset. Alternatively, or in combination, an adapter plate is received in the pedestal jaw on the bearing adapter to retain the reduced coefficient of friction surface member above or below the adapter plate. The adapter plate may be provided with surfaces about perpendicular to the longitudinal and lateral axes of the side frame to support elastomeric members, which may provide different longitudinal and lateral spring rates in response to a load applied to the truck.

19 Claims, 4 Drawing Sheets

(56) References Cited

U.S. PATENT DOCUMENTS

| | | | | |
|---|---|---|---|---|
| 3,965,825 | A | 6/1976 | Sherrick | |
| 4,003,316 | A | 1/1977 | Monselle | |
| 4,030,424 | A | 6/1977 | Garner | |
| 4,131,069 | A | 12/1978 | List | |
| 4,278,030 | A | 7/1981 | Ahlborn | |
| 4,416,203 | A | 11/1983 | Sherrick | |
| 4,483,253 | A | 11/1984 | List | |
| 4,570,544 | A | 2/1986 | Smith | |
| 4,674,412 | A | 6/1987 | Mulcahy | |
| 4,938,152 | A | 7/1990 | List | |
| 5,027,716 | A | 7/1991 | Weber | |
| 5,081,933 | A | 1/1992 | Lapp | |
| 5,222,441 | A | 6/1993 | Weber | |
| 5,237,933 | A | 8/1993 | Bucksbee | |
| 5,241,913 | A | 9/1993 | Lamson | |
| 5,243,920 | A | 9/1993 | Lamson | |
| 5,404,826 | A * | 4/1995 | Rudibaugh | B61F 5/32 105/222 |
| 5,461,986 | A | 10/1995 | Sarnicki | |
| 5,463,964 | A | 11/1995 | Long | |
| 5,503,084 | A | 4/1996 | Goding | |
| 5,509,358 | A | 4/1996 | Hawthorne | |
| 5,562,044 | A | 10/1996 | Wiebe | |
| 5,562,045 | A | 10/1996 | Rudibaugh | |
| 5,647,283 | A | 7/1997 | McKisle | |
| 5,722,327 | A | 3/1998 | Hawthorne | |
| 5,735,216 | A | 4/1998 | Bullock | |
| 5,746,137 | A | 5/1998 | Hawthorne | |
| 5,799,582 | A | 9/1998 | Rudibaugh | |
| 5,802,982 | A | 9/1998 | Weber | |
| 5,832,838 | A | 11/1998 | Shaw | |
| 5,874,426 | A | 2/1999 | Kornberg et al. | |
| 5,893,330 | A | 4/1999 | Emery | |
| 5,918,547 | A | 7/1999 | Bullock | |
| 5,924,366 | A | 7/1999 | Trainer | |
| 5,943,960 | A | 8/1999 | Becker | |
| 6,006,674 | A | 12/1999 | Ahmadian | |
| 6,035,788 | A | 3/2000 | Mau | |
| 6,053,840 | A | 4/2000 | Jones | |
| 6,053,469 | A | 5/2000 | Burgarella | |
| 6,092,469 | A | 7/2000 | Monsell | |
| 6,102,574 | A | 8/2000 | Proschel | |
| 6,119,602 | A | 9/2000 | Yoshino | |
| 6,148,734 | A | 11/2000 | Gwinn | |
| 6,178,894 | B1 | 1/2001 | Leingang | |
| 6,189,456 | B1 | 2/2001 | Smith | |
| 6,234,083 | B1 | 5/2001 | Tack | |
| 6,347,588 | B1 | 2/2002 | Leingang | |
| 6,357,360 | B1 | 3/2002 | Arnswald | |
| 6,371,033 | B1 | 4/2002 | Smith | |
| 6,422,155 | B1 | 7/2002 | Heyden | |
| 6,439,130 | B1 | 8/2002 | Scheffel | |
| 6,672,224 | B2 | 1/2004 | Weber et al. | |
| 6,817,301 | B1 | 11/2004 | Bullock | |
| 6,871,598 | B2 | 3/2005 | Schaller | |
| 6,910,426 | B2 | 6/2005 | Krishnaswami | |
| 7,143,700 | B2 | 12/2006 | Forbes | |
| 7,231,878 | B2 | 6/2007 | Wike | |
| 7,263,930 | B2 | 9/2007 | Pershwitz | |
| 7,308,855 | B2 | 12/2007 | Van Auken | |
| 7,387,074 | B2 | 6/2008 | Myers | |
| 7,448,329 | B2 | 11/2008 | Muller | |
| 7,497,169 | B2 | 3/2009 | Forbes | |
| 7,513,199 | B2 | 4/2009 | Van Auken | |
| 7,527,131 | B1 | 5/2009 | Wike | |
| 7,533,617 | B2 | 5/2009 | Krautzig | |
| 7,654,204 | B2 | 2/2010 | Forbes | |
| 7,739,961 | B2 | 6/2010 | East | |
| 7,798,069 | B2 | 9/2010 | Aitken | |
| 7,845,288 | B2 | 12/2010 | Forbes | |
| 7,966,946 | B1 | 6/2011 | Novak | |
| 8,011,306 | B2 | 9/2011 | Forbes | |
| 8,047,139 | B2 | 11/2011 | Gednek | |
| 8,474,383 | B1 | 7/2013 | Berg | |
| 2002/0152923 | A1 | 10/2002 | Weber | |
| 2005/0005815 | A1 | 1/2005 | Forbes et al. | |
| 2007/0084377 | A1 | 4/2007 | Myers | |
| 2009/0158957 | A1* | 6/2009 | East | B61F 5/305 105/224.1 |
| 2012/0186486 | A1* | 7/2012 | Tavares | B61F 5/32 105/224.1 |
| 2012/0318166 | A1 | 12/2012 | Wike | |
| 2014/0060380 | A1 | 3/2014 | Berg | |
| 2014/0174317 | A1 | 5/2014 | Wang | |

OTHER PUBLICATIONS

AAR Manual of Standards and Recommended Practices, Journal Roller Bearing Adapters for Freight Cars, Specification M-924, adopted 1965; last revised 2011.

International Search Report issued for International Appl. PCT/US13/57452 dated Feb. 7, 2014.

International Search Report issued for International Appl. PCT/US13/53147 dated Apr. 9, 2014.

International Search Report for Appl. No. PCT/US15/63338 dated Apr. 1, 2016.

* cited by examiner

BEARING ADAPTER SIDE FRAME INTERFACE FOR A RAILWAY CAR TRUCK

FIELD OF THE INVENTION

The invention relates to an interface between a bearing adapter and a side frame in a railway car truck. Specifically, the invention relates to improvements in the bearing adapter which provide for the combination of a reduced friction surface member between the pedestal roof and the bearing adapter, and also to an adapter plate design that provides for an improved interface between the pedestal jaw and the bearing adapter.

BACKGROUND OF THE INVENTION

The conventional railway car truck in use in North America for several decades has been the three-piece truck, comprising a pair of parallel side frames oriented longitudinally connected by a transversely mounted bolster. The bolster is supported on the side frames by spring sets. The wheel sets of the truck are received in bearing adapters placed in leading and trailing pedestal jaws in the side frame, so that axles of the wheel sets are parallel. The bearing adapters permit slight angular adjustment of the axles. The railway car is mounted on the center plate of the bolster, which allows the truck to pivot with respect to the car. The spring sets permit the side frames to move somewhat with respect to the bolster, about the longitudinal, vertical, and transverse axes.

On straight track, a three piece truck with parallel side frames and parallel axles perpendicular to the side frames (i.e., a perfectly "square" truck) rolls without inducing lateral forces between the wheel flange and the rail. However, at high speeds, minor perturbations in the track or in the equipment can lead to a condition known as "hunting," which describes an oscillating lateral movement of the wheel sets that causes the railcar to move side-to-side on the track. Hunting may be dangerous when the oscillations attain a resonant frequency.

Curved track poses a different set of challenges for the standard three-piece truck. When a railway car truck encounters a turn, the distance traversed by the wheels on the outside of the curve is greater than the distance traversed by wheels on the inside of the curve, resulting in lateral and longitudinal forces between the wheel and the rail. These wheel forces cause the wheel set to turn in a direction opposing the turn. On trucks with insufficient rigidity this results in a condition variously known as "warping," "parallelogramming" or "lozenging," wherein the side frames remain parallel, but one side frame moves forward with respect to the other. The "lozenging" condition can cause increased wear on the track and equipment, increase rolling resistance, and if severe enough result in a derailment.

In order to minimize hunting and to provide the standard three-piece truck with the ability to negotiate turns, the truck is generally designed to allow a nonparallel condition of the axles during the turn, which is then recovered on straight track. This may be achieved by permitting relative movement of the bearing adapters within the pedestal jaws of the side frames.

In order to improve curving performance, it is known to interpose an elastomeric bearing member between the side frame and the tops of the bearing adapters. The elastomeric member permits the side frames to maintain a ninety degree relationship with the wheel sets on straight track, while on curved track allowing the wheel sets some freedom of movement to depart from a square relationship to respond to turning forces and accommodate the nonparallel condition of the axles. The elasticity of the member biases the truck to return to its square position. Various systems to securely attach elastomeric pads to the side frame pedestal jaw are described in the prior art, including U.S. Pat. No. 7,966,946 and U.S. Pat. No. 4,674,412, which also contains a description of the prior art related to elastomeric pads generally. However, the prior art disclosure relating to elastomeric pads fails to adequately provide a different spring rate in the longitudinal direction compared to the lateral direction.

The prior art is also replete with systems for maintaining the bearing adapter securely in place in the pedestal jaw. U.S. Pat. No. 5,503,084, for example, describes a truck having a system for holding the bearing adapter in position within the pedestal jaw using tie rods running through a bore in the bearing adapter to prevent the bearing adapters from rotationally moving.

U.S. Pat. Nos. 7,845,288; 7,739,961; and 7,497,169 describe interfaces between a side frame pedestal jaw and a bearing adapter that may include a shear pad, wear plate, as well as other elements.

U.S. Pat. No. 3,844,226 describes a system to dampen or reduce the lateral forces transmitted to the side frame causing the lateral oscillations phenomenon ("hunting") wherein a non-metallic surface with a low friction coefficient is positioned between a pedestal jaw and a bearing adapter, allowing the wheel set to move side to side in each direction with respect to the truck side frame, without transmitting force to the large masses of the truck parts.

U.S. Patent Application Publication No. 2014/0060380, which is incorporated by reference in its entirety, discloses that an interconnection between a side frame and wheel set with a high spring constant in the longitudinal direction relative to the lateral direction is advantageous to truck steering and riding performance. In specific embodiments, a longitudinal spring constant of about 20,000 lb/in to about 40,000 lb/in, and a lateral spring constant in the range of about 3,000 lb/in to about 5,000 lb/in was found to yield improved results over the prior art. It is desirable to provide additional modes to accomplish these performance objectives.

SUMMARY OF THE INVENTION

One object of the invention is to provide an improved system to interpose a reduced coefficient of friction interface between the pedestal jaw and the bearing adapter that will reduce cold flow of the low friction material.

Another object of the invention is to provide a reduced coefficient of friction interface between the pedestal jaw and the bearing adapter without significantly impacting the overall height of the truck.

Still another object of the invention is to provide an adapter plate positioned between the bearing adapter and the pedestal jaw to orient elastomeric members in the longitudinal and lateral directions. In particular it is an object of the invention to provide means for orienting separate elastomeric members in the side frame/bearing adapter interface to allow for a higher spring constant in the longitudinal direction relative to the lateral direction.

Yet another object of the invention is to facilitate installation of elastomeric pads in the wheel set/side frame interface by combining elastomeric pads positioned in the longitudinal and/or in the lateral direction with the adapter plate, resulting in fewer components to be installed.

These and other objects of the invention may be achieved with an interface according to the invention, which in one aspect, is directed to an adapter interface positioned in a side frame pedestal jaw receiving a transversely mounted wheel set. The wheel set received in the pedestal jaw comprises an axle, a wheel and a roller bearing. The pedestal jaw comprises opposed end walls, a pedestal roof and thrust lugs on each of the opposed end walls. The pedestal jaw receives a bearing adapter between the roller bearing and the pedestal roof. The bearing adapter according to the invention has a lower curved surface facing the roller bearing, an upper surface facing the pedestal roof, and opposed slots for mating with respective thrust lugs on the pedestal jaw end walls. The upper surface of the bearing adapter has a recess, defined by at least one recess wall on the perimeter of the recess (and preferably a continuous recess wall along the perimeter of the upper surface of the bearing adapter). The recess receives a reduced friction surface member with a thickness, an upper surface facing the pedestal roof, a lower surface in the recess of the bearing adapter, and a portion of the thickness protruding above the recess wall.

In another aspect, the invention is directed to a modified adapter plate positioned between the pedestal roof and the bearing adapter. The adapter plate has a horizontal surface facing the pedestal roof and first and second legs received in the respective slots of the bearing adapter. The first and second legs each have a surface perpendicular to the longitudinal axis of the side frame. In embodiments, one or more of the surfaces perpendicular to the longitudinal axis of the side frame supports an elastomeric pad. In embodiments, the first and second legs are provided with at least one extension surface perpendicular to the transverse direction of the side frame, which extension surface may support a second elastomeric pad.

DETAILED DESCRIPTION OF THE INVENTION

Figure 1:
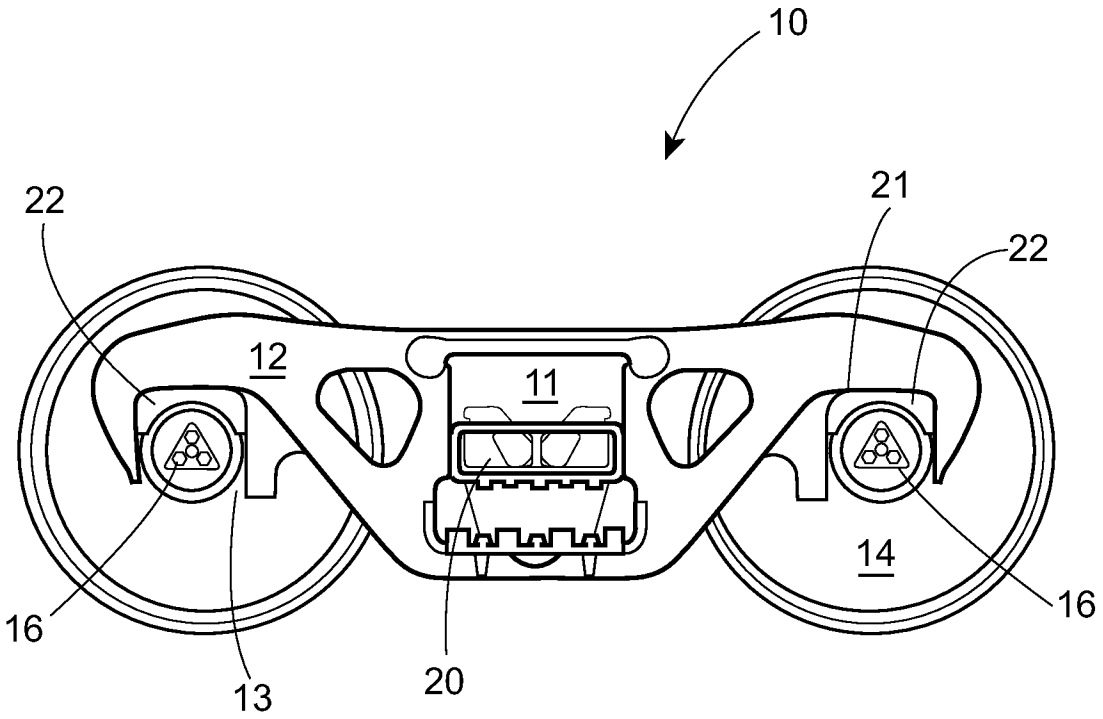
FIG. 1 is a side view of a railway car truck.

Directions and orientations herein refer to the normal orientation of a railway car in use. Thus, unless the context clearly requires otherwise, the "longitudinal" axis or direction is parallel to the rails and in the direction of movement of the railway car on the track in either direction. The "transverse" or "lateral" axis or direction is in a horizontal plane perpendicular to the longitudinal axis and the rail. The term "inboard" means toward the center of the car, and may mean inboard in a longitudinal direction, a lateral direction, or both. Similarly, "outboard" means away from the center of the car. "Vertical" is the up-and-down direction, and "horizontal" is a plane parallel to the rails including the transverse and longitudinal axes. A truck is "square" when its wheels are aligned on parallel tracks and the axles are parallel to each other and perpendicular to the side frames. The "leading" side of the truck means the first side of a truck on a railway car to encounter a turn; and the "trailing" side is opposite the leading side.

"Elastomer" and "elastomeric" refer to polymeric materials having elastic properties so that they exert a restoring force when compressed. Examples of such materials include, without limitation, thermoplastic elastomer (TPE), natural and synthetic rubbers such as: neoprene, isoprene, butadiene, styrene-butadiene rubber (SBR), polyurethanes, and derivatives.

"Hardness" refers to the resistance of the elastomeric materials to deformation that may occur from the application of compressive force. It is dependent on the properties of the material, such as: ductility, stiffness, plasticity, toughness and the stress applied. The hardness of a material is measured in Durometer classifications, where type A is used for softer materials and type D is used for harder materials.

"Coefficient of friction" means the ratio of lateral to normal forces between two sliding surfaces. Unless the context clearly requires otherwise, a "reduced coefficient of friction" means that the coefficient of friction is reduced as compared to steel-on-steel without lubrication, which is the conventional interface between the pedestal roof and a bearing adapter.

As used herein, a "bearing adapter" is a part which fits in a pedestal jaw of a side frame. One side of the bearing adapter is curved for engagement with the roller bearing of the axle and the other side fits in the pedestal jaw. Typically, a thrust lug protrudes from the vertical side wall of the pedestal jaw, and mates with a slot on the bearing adapter to maintain the bearing adapter in place and provide limits on the range of relative movement between the bearing adapter and pedestal jaw.

"Interconnection" between the side frame and the bearing adapter refers to any member contacting and transmitting force (or reducing the transmission of force) between the side frame and the bearing adapter.

A railway car truck according to the invention includes a plurality of substantially identical elements, such as two side frames, two wheel sets, four wheels, etc. It is understood herein that a description of one element herein serves to describe all such substantially identical elements.

The Association of American Railroads ("AAR") sets forth standards for railroad trucks in Standard M-976. Standard M-924 sets forth standards relating to bearing adapters specifically. Reference to AAR standards refers to the standards in effect on the filing date of this application. The term "industry standard" generally refers to one or more AAR standards, unless the context clearly requires otherwise.

In a first aspect of the invention, an improved bearing adapter interface includes a recess in a top surface of the bearing adapter to retain a reduced coefficient of friction surface member.

Figure 2:
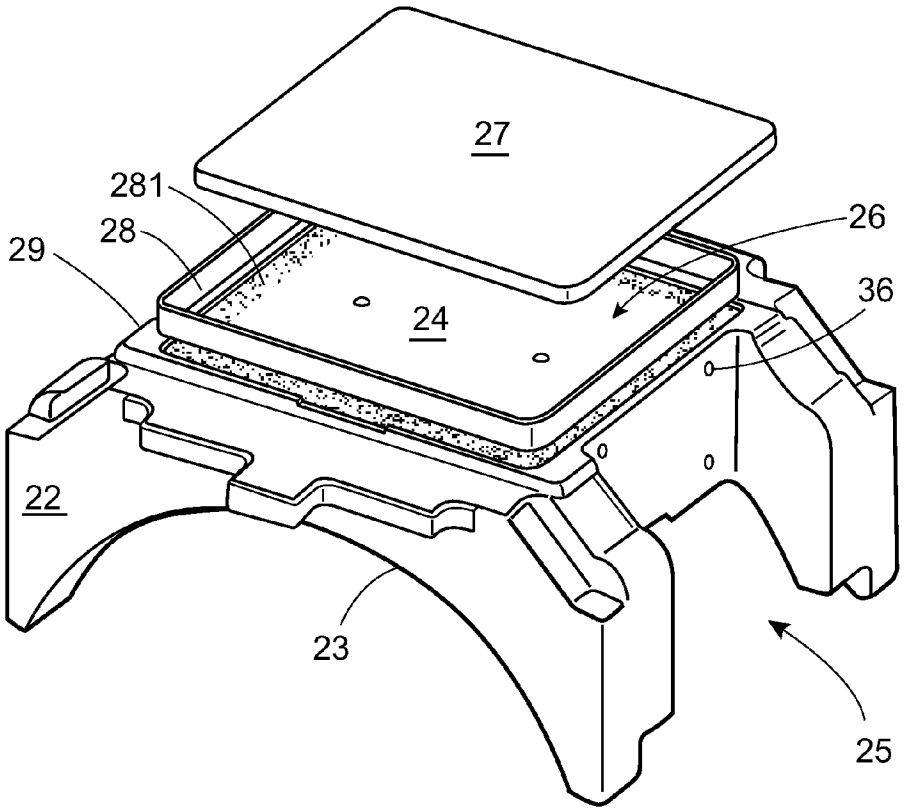
FIG. 2 is an isometric view of a bearing adapter and a reduced friction surface member received in the bearing adapter.

FIG. 1 depicts a truck 10 in side view, including side frame 12, having pedestal jaw 13, and a side frame window 11, receiving bolster 20. Roller bearing 16, bearing adapter 22 (shown in an exploded view in FIG. 2), wheel 14, and an axle, together form the wheel set received in pedestal jaw 13. Referring to FIG. 2, curved bottom surface 23 of bearing adapter 22 engages roller bearing 16 and flat upper surface 24 of bearing adapter 22 faces pedestal roof 21. As known in the art, a wear plate (not shown) may be positioned at the interface with the pedestal roof.

FIG. 2 provides an exploded view of the interface between bearing adapter 22 and side frame 12 according to one embodiment of the invention, in which bearing adapter 22 comprises curved bottom surface 23, flat upper surface 24, and slots 25 on leading and trailing sides of bearing adapter 22 for receiving thrust lugs positioned on the pedestal end walls. In addition, bearing adapter 22 is provided with recess 26 on the flat upper surface defined by at least one recess wall 29 on the perimeter of recess 26. Recess 26 prevents reduced friction surface member 27 from moving beyond recess wall 29. Recess 26 may be machined from an existing bearing adapter or cast. Recess wall 29 includes at least a portion along each side and along each longitudinal end of the recess to retain the reduced coefficient of friction member. Preferably recess wall 29 is a substantially continuous wall with an even height along substantially the entire perimeter of the recess to allow for a uniform distribution of load, thereby minimizing irregular deformation and cold flow of reduced coefficient of friction member 27. In the embodiment shown, recess wall 29 is substantially continuous around the periphery of recess 26. "Substantially continuous," in this context means that any break in the wall should not impact the ability of the recess wall to hold reduced friction surface member 27 and distribute load across the interface area.

Recess 26 is preferably formed so as to maximize the surface area of the reduced coefficient of friction surface member 27. For example, an AAR standard K class adapter allows maximum dimensions of approximately 35 $in^2$ (5.5 inches by 6.375 inches) without modifying the overall size and shape of the standard adapter. However a larger interface surface area may be obtained by altering the AAR standard adapter. As used herein, a standard K class adapter is one meeting AAR standard M-924 dimension specifications.

Recess 26 receives reduced friction surface member 27 to provide a reduced coefficient of friction between the pedestal roof (or a wear plate) and the bearing adapter. Preferably, the reduced friction surface in contact with the pedestal roof provides a coefficient of friction less than or equal to 0.4, more preferably less than or equal to 0.25, more preferably still less than or equal to 0.1, and more preferably still less than or equal to 0.08. One advantage of the invention is that a large upper surface 24 of bearing adapter 22 allows for a reduced coefficient of friction over a large area in order to decrease the normal stress.

Reduced friction surface member 27 is selected to provide a reduced coefficient of friction and at the same time exhibit good wear resistance so that the low friction surface at the interface remains operable over a period of time. These may be competing attributes. In embodiments, at least the top surface of the reduced friction surface member comprises a material selected from the group consisting of polytetrafluoroethylene, graphite, molybdenum disulfide, tungsten disulfide, boron nitride, titanium nitride, chromium nitride, tungsten carbide, titanium carbide, chromium carbide, W—C:H diamond-like carbon coating, $AlMgB_{14}$, chrome, silver plating, zinc plating, zinc alloy plating, nickel plating, thermal spray, grease, and oil. Preferably, the reduced friction surface member is a block comprising one or more of the following materials: polytetrafluoroethylene (PTFE), PTFE fibers, resin, woven fabric, and engineered plastics, which may be included with functional additives known in the art to impart desired properties to polymer compositions. These materials may also be bonded to a metal or composite substrate. Preferably, the reduced friction surface member is non-hyper elastic, which is less likely to be subjected to shearing compared to a hyper-elastic material. Conventional adapter pad materials are hyper-elastic.

In placing a member between the pedestal jaw and the adapter, care must be taken to not significantly increase the height of the truck. AAR standards impose strict dimensional tolerances for the height of a railway car, and even a small variation in truck height may cause problems in interoperability of one part with another. In embodiments of the invention, the distance from the top of roller bearing 16 to pedestal roof 21 is maintained as close as possible to AAR standards, i.e., less than approximately 1.25 inches for the standard bearing adapter and an additional thickness for a wear plate. Preferably, the reduced friction surface received in the recess of the bearing adapter has a thickness in the range of about 0.1 to about 0.5 inch and the recess receiving the reduced friction surface has a depth in the range of about 0.05 inch to about 0.4 inch, and preferably about 0.15 inch to about 0.35 inch to retain the reduced friction surface in a manner that will allow for minimal cold flow or deformation of the reduced friction surface, while maximizing the reduced friction surface's utility time before it wears down resulting in contact between the steel or iron portion of the bearing adapter and the pedestal roof or the wear plate. About 20% to about 80% of the thickness of the reduced friction surface may protrude above the highest point of the recess wall toward the pedestal roof. With less than 20% of the thickness of the reduced friction surface protruding from the recess, the portion protruding may wear too rapidly, resulting in a metal to metal contact. At the opposite extreme, if more than 80% of the thickness of the reduced friction surface protrudes from the recess, the recess may not adequately contain the member, resulting in deformation of the reduced friction member. Therefore, preferably, the portion of the thickness protruding above the recess wall is in a range of 40% to 60% to obtain a balance between the different design parameters.

The adapter interface including recess 26 may further comprise a sacrificial member positioned on the perimeter of the recess. The part is made of a material that is softer than steel or the material of the bearing adapter on the one hand, yet deforms better than polytetrafluoroethylene or the material of the reduced friction surface member on the other hand. This includes, but is not limited to, materials such as brass, plastic, and soft metal alloys, so that if the reduced friction surface is worn down during use, the sacrificial part contacts the pedestal roof or wear plate and wears away before direct contact of metal to metal with increased coefficient of friction such as that of the bearing adapter with the pedestal roof. In the embodiment shown, the sacrificial member takes the form of cage 28, a continuous wall in a closed shape placed around the perimeter of recess 26. Preferably, the cage has a thickness of about 0.1 to about 0.2 inches and a height less than the thickness of the reduced friction surface member. Preferably about 10% to about 50% of the thickness of the reduced friction surface member protrudes above the cage walls towards the pedestal roof, thereby maintaining reduced coefficient of friction between the bearing adapter and the pedestal roof for the wear life of the reduced friction surface member, while optimizing the resistance to cold flow.

Elasticity in the vertical direction is desirable for cage 28 so that cage 28 does not contribute significantly to friction with the pedestal roof (or a wear plate, as the case may be). Low vertical stiffness may be provided with compressible material 281, such as an elastomer or foam, under cage 28 in the recess.

In the foregoing, reduced friction surface member 27 is depicted as bearing against pedestal roof 21. It is also known in the art to provide a wear plate between the bearing adapter and the pedestal roof. Bearing adapter 22 incorporating reduced friction surface member as described above may also be used with a wear plate interposed at the pedestal roof 21, between the bearing adapter and the side frame.

In another aspect, a bearing adapter interface according to the invention comprises an adapter plate to isolate and better control longitudinal and lateral spring forces on the bearing adapters with respect to the truck side frames to optimize steering and stability. The adapter plate may also be used to accommodate a reduced coefficient of friction surface member 27.

Figure 3:
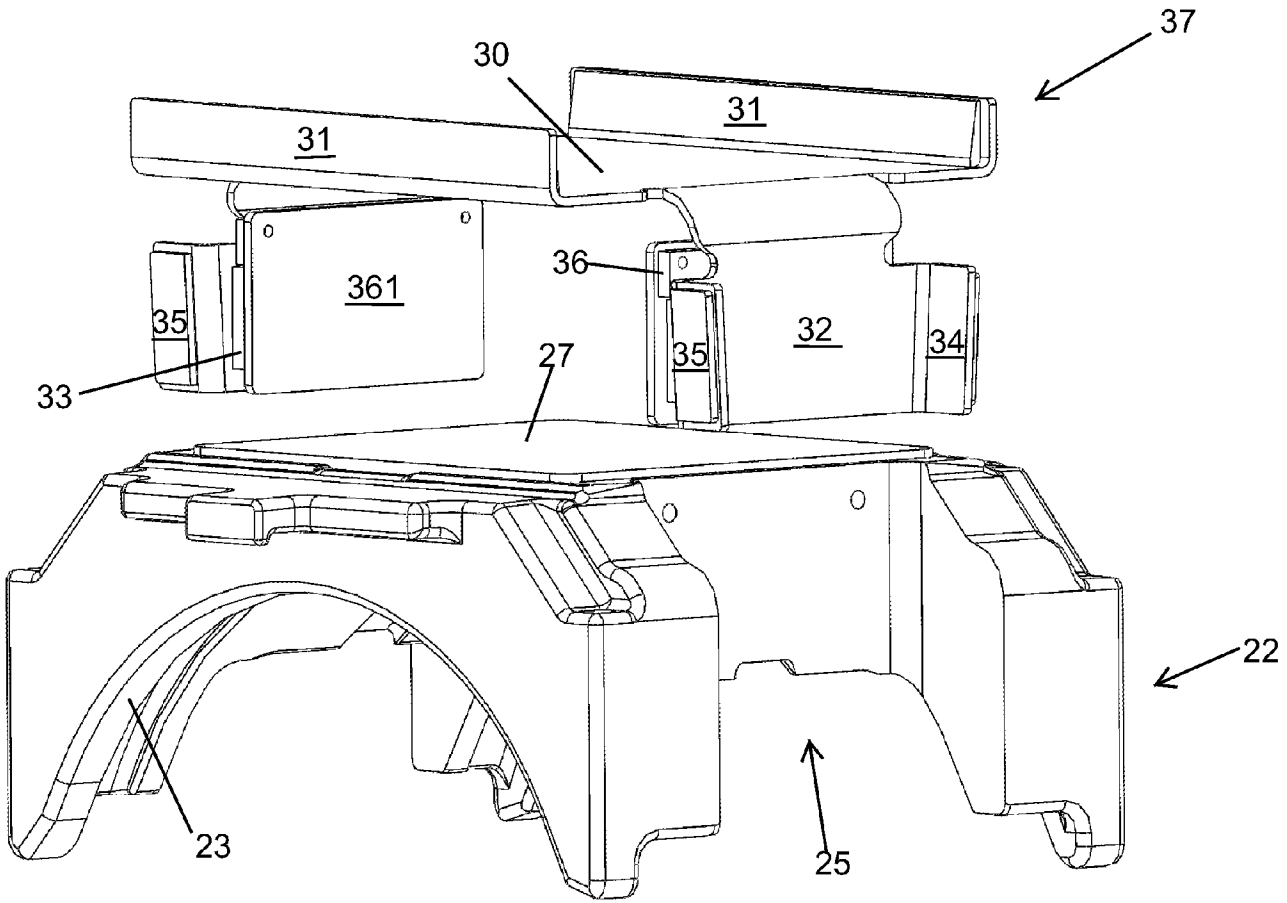
FIG. 3 depicts an adapter plate received on a bearing adapter according to an embodiment of the invention.

FIG. 3 depicts an embodiment according to this aspect of the invention, including an adapter plate 37 engaging bearing adapter 22. In one arrangement, adapter plate 37 includes top surface 30 abutting pedestal roof 21, and top side walls 31 engaging lateral edges of the pedestal roof. Top side walls 31 provide hard stops preventing excessive movement of the bearing adapter in the lateral direction as well as adding rotational stiffness. Adapter plate 37 provides surfaces on which elastomeric pads 33, 35 may be positioned to control the spring rate of the interface in the longitudinal and lateral directions, respectively. The upper surface 30 of the adapter plate may be equipped with a rubber damper (not shown), preferably ⅛ inch or less, acting as a suspension device to equalize the distribution of load on upper surface 30, minimize localized concentration of load and reduce or prevent damage to reduced coefficient of friction surface member 27. The horizontal surface of the adapter plate opposite surface 30 may be polished or treated to reduce friction caused by contact with reduced coefficient of friction surface member 27. In embodiments, and not by way of limitation, the surface in contact with reduced coefficient of friction surface member 27 may be polished to a #8 (mirror) surface finish (approximately 4 to 5 microinches RMS).

In other embodiments, reduced coefficient of friction surface member 27 may be positioned above the adapter plate. For example, in the arrangement shown in FIG. 4, a modified adapter plate 371 is provided with top surface 30 which abuts reduced friction surface member 27. Reduced friction surface member 27 is positioned between modified adapter plate 371 and pedestal roof 21. A conventional wear plate may also be interposed between pedestal roof 21 and reduced coefficient of friction surface member 27. In this arrangement, modified adapter plate 371 may include a recess 38, similar in effect to the recess described in connection with the previous embodiment, wherein recess 26 is provided on the roof of the bearing adapter. As in the previous embodiment, the recess may be further equipped with a sacrificial member positioned on the perimeter of the recess, and dimensions are selected so that the distance from the top of roller bearing 16 to pedestal roof 21 is maintained as close as possible to industry standards. As in the previous embodiment, a thin rubber damper element (not shown) may be provided to reduce wear on reduced friction member 27. Thus, reduced friction surface member and adapter plate (37, 371) together may be considered an adapter plate assembly, and a rubber damper may be positioned above or below the adapter plate assembly.

Figure 4:
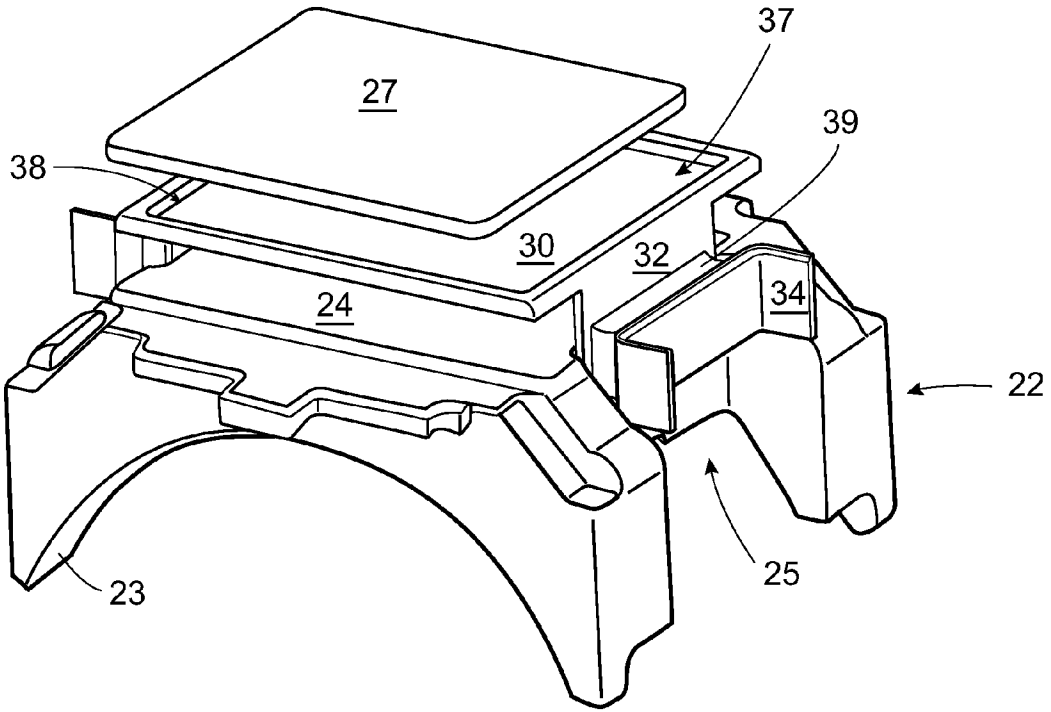
FIG. 4 depicts an adapter plate and bearing adapter assembly according to another embodiment of the invention.

While the geometry of adapter plate 37 differs from the modified adapter plate 371 according to different embodiments, in each case first and second legs 32 are about perpendicular to top surface 30 and received in slots 25 in bearing adapter 22. "About perpendicular" means that a surface or element may not be exactly perpendicular with respect to a reference surface, element or line. Such variation may be by design, to facilitate installation, for example, or other reason, and generally means that the angle varies less than 5 degrees from a 90° degree angle. Both adapter plate 37 and modified adapter plate 371 may be considered an "adapter plate" as that term is used herein. However, modified adapter plate 371 has a recess for receiving a low coefficient of friction material and does not have a wear surface. Elastomeric pad 33 on surface may be pre-biased in the process of installing adapter plate 37 on bearing adapter 22. In the embodiment of FIG. 4 a similar pad 39 is provided facing away from bearing adapter 22. Preferably, two such pads 33, 39 are provided on opposite longitudinal sides of bearing adapter 22 in respective slots 25.

An extension 34 extends longitudinally from adapter plate 37 presenting a surface about perpendicular to the transverse direction of side frame 12. Preferably, a pair of extensions 34 are provided on lateral sides of each leg 32, extending away from legs 32 in a longitudinal direction. The about perpendicular members 34 and 32 may support elastomeric pads 33 and 35 of different hardness, to isolate the longitudinal and the lateral stiffness.

In the embodiment of FIG. 3, a surface of adapter plate 37 facing bearing adapter 22, perpendicular to the longitudinal axis of the side frame, is equipped with an elastomeric member 33. Elastomeric member 33, which may be pre-biased when installed on the bearing adapter, is referred to as a "first" elastomeric member, although it is contemplated and preferred that identical first elastomeric pads 33 may be, and preferably are, positioned on leading and trailing sides of bearing adapter 22. Preferably, a pair of opposed pre-biased elastomeric members is provided positioned on opposed legs 32 facing bearing adapter 22. Elastomeric member 33 may be made of a relatively hard (such as 50 Duro A to 75 Duro D, preferably 60 to 85 Duro A hardness) elastomer, such as a polyurethane, to provide a relatively stiff longitudinal spring rate. The deformation required to pre-bias member 33 depends on the load required and the elastomer used. Extensions 34 on legs 32 of adapter plate 37 may be equipped with lateral elastomeric members 35 bearing against lateral bearing surfaces in slots 25 of bearing adapter 22. Elastomeric members 35 positioned perpendicular to a transverse axis of the side frame are referred to as "second" elastomeric members, it being understood that there may be, and preferably are, a plurality of second elastomeric members positioned on each lateral side of the thrust lug and in leading and trailing slots 25 in bearing adapter 22. Elastomeric members 35 are composed of a softer rubber, preferably having a maximum of 95 Duro A hardness, and more preferably having a maximum 80 Duro A hardness, to accommodate a relatively softer lateral spring rate. In embodiments, the adapter plate supporting elastomeric pads having different hardness provides a lateral spring constant between 3000 lb/in and 5000 lb/in and a longitudinal spring constant between 20,000 lb/in and 40,000 lb/in, and a restoring force in response to an applied load.

In order to prevent permanent deformation of the elastomeric pads, a hard stop may be positioned proximate the pre-biased elastomeric member. The hard stop creates an unyielding surface which bears a load when the elastomeric pad is compressed, such as when a braking load is applied, which serves to limit the amount of deflection experienced by the elastomeric member, thereby minimizing permanent deformation or cold flow. In the embodiment shown in FIG. 3, a metal shim 361 is provided between bearing adapter 22 and elastomeric pads 33 in slots 25 on leading and trailing legs 32 of adapter plate 37. A hard stop 36 between adapter plate 37 and shims 361 bears a load after a predetermined amount of deformation of elastomeric member 33 when a braking load causes the side frame to bear against the bearing in the longitudinal direction. Those of ordinary skill in the art will appreciate that another unyielding surface positioned proximate an elastomeric member could provide a similar hard stop to prevent deformation of the pads.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. For example, although the Figures depict a particular configuration of side frame, consistent with AAR Standard M 976, embodiments of the invention may find utility with other truck designs. A feature or dependent claim limitation described in connection with one embodiment or independent claim may be adapted for use with another embodiment or independent claim, without departing from the scope of the invention.

The invention claimed is:

1. An interface between a railway car side frame and a bearing adapter, the side frame being oriented longitudinally with respect to a railway car, having a pedestal jaw receiving a transversely mounted wheelset; the wheelset being received in the pedestal jaw and comprising an axle, a wheel, and a roller bearing; the pedestal jaw having opposed end walls, a pedestal roof, and a thrust lug on each of the opposed end walls; the interface comprising:

a bearing adapter received in the pedestal jaw between the roller bearing and the pedestal roof, the bearing adapter having a curved bottom surface facing the roller bearing, an upper surface facing the pedestal roof, and opposed slots mating with the respective thrust lugs on the pedestal jaw end walls;

an adapter plate positioned between the pedestal roof and the bearing adapter, said adapter plate having a horizontal surface facing the pedestal roof, and first and second legs received in respective slots of the bearing adapter;

the first and second legs each having a surface about perpendicular to the longitudinal axis of the side frame;

the upper surface of the bearing adapter having a recess, defined by at least one recess wall on the perimeter of the recess and a reduced friction surface member received in the recess in the bearing adapter and interposed between the bearing adapter and a bottom surface of the adapter plate, providing a coefficient of friction with the bottom surface of the adapter plate of less than or equal to 0.4, wherein the recess of the bearing adapter comprises a continuous recess wall around the perimeter of the recess; and wherein about 20% to about 80% of the thickness of the reduced friction surface member protrudes above the recess wall towards the pedestal roof.

2. The interface according to claim 1, wherein the adapter plate further comprises side walls engaging lateral edges of the pedestal roof.

3. The interface according to claim 1, further comprising a first elastomeric member on each said surface of the first and second legs about perpendicular to the longitudinal axis of the side frame.

4. The adapter interface according to claim 3, further comprising a hard stop proximate the first elastomeric member bearing a load at a predetermined deformation of the respective first elastomeric member.

5. The interface according to claim 1, wherein each of the first leg and the second leg of the adapter plate has a pair of extension surfaces extending longitudinally on opposed lateral sides of the respective first leg and second leg; and further comprising a second elastomeric member on each extension surface oriented about perpendicular to a transverse axis of the side frame.

6. The interface according to claim 5, wherein the first elastomeric member affords a stiffer spring rate than the second elastomeric member.

7. The interface according to claim 1, wherein a surface of the adapter plate contacting the reduced coefficient of friction material is polished.

8. A bearing adapter interface according to claim 1, wherein the bearing adapter is an AAR standard K class adapter.

9. The interface according to claim 1, wherein the reduced friction surface member received in the recess provides a coefficient of friction less than 0.25.

10. The interface according to claim 1, wherein the thickness of the reduced friction surface member is in a range of 0.1 to 0.5 inches.

11. The interface according to claim 1, wherein the reduced friction surface member comprises one or more of the following materials or one or more of the following materials bonded to a metal or composite substrate: polytetrafluoroethylene (PTFE), PTFE fibers, resin, woven fabric, and engineered plastic.

12. The interface according to claim 1, wherein the continuous recess wall on the perimeter of the recess has about 40% to about 60% of the thickness of the reduced friction surface member protruding above the recess wall toward the pedestal roof.

13. An interface between a railway car side frame and a bearing adapter, the side frame being oriented longitudinally with respect to a railway car, having a pedestal jaw receiving a transversely mounted wheelset; the wheelset being received in the pedestal jaw and comprising an axle, a wheel, and a roller bearing; the pedestal jaw having opposed end walls, a pedestal roof, and a thrust lug on each of the opposed end walls; the interface comprising:

a bearing adapter received in the pedestal jaw between the roller bearing and the pedestal roof, the bearing adapter having a curved bottom surface facing the roller bearing, an upper surface facing the pedestal roof, and opposed slots mating with the respective thrust lugs on the pedestal jaw end walls;

an adapter plate having a recess in an upper surface thereof receiving a reduced friction surface member; and wherein the reduced friction surface member has a thickness, an upper surface facing the pedestal roof or a wear plate and a lower surface facing the adapter plate.

14. The interface according to claim 13, further comprising a sacrificial member positioned on the perimeter of the recess on the upper surface of the adapter plate.

15. The interface according to claim 13, wherein the reduced friction surface member received in the recess contacts the pedestal roof and provides a coefficient of friction less than 0.25.

16. The interface according to claim 13, wherein the thickness of the reduced friction surface member is in a range of 0.1 to 0.5 inches.

17. The interface according to claim 13, wherein the recess of the adapter plate comprises a continuous recess wall around the perimeter of the recess; and wherein about 20% to about 80% of the thickness of the reduced friction surface member protrudes above the recess wall towards the pedestal roof.

18. The interface according to claim 17, wherein the continuous recess wall on the perimeter of the recess has about 40% to about 60% of the thickness of the reduced friction surface member protruding above the recess wall toward the pedestal roof.

19. The interface according to claim 13, wherein the reduced friction surface member comprises one or more of the following materials or one or more of the following materials bonded to a metal or composite substrate: polytetrafluoroethylene (PTFE), PTFE fibers, resin, woven fabric, and engineered plastic.

* * * * *